US010136736B2

(12) United States Patent
Franken

(10) Patent No.: US 10,136,736 B2
(45) **Date of Patent: *Nov. 27, 2018**

(54) UNDER MATTRESS SUPPORT

(71) Applicant: Colleen M. Franken, Weston, FL (US)

(72) Inventor: Colleen M. Franken, Weston, FL (US)

( * ) Notice: Subject to any disclaimer, the term of this patent is extended or adjusted under 35 U.S.C. 154(b) by 250 days.

This patent is subject to a terminal disclaimer.

(21) Appl. No.: 14/970,648

(22) Filed: Dec. 16, 2015

(65) Prior Publication Data

US 2017/0049242 A1 Feb. 23, 2017

Related U.S. Application Data

(63) Continuation-in-part of application No. 14/170,776, filed on Feb. 3, 2014, now Pat. No. 9,241,578, which is a continuation-in-part of application No. 13/758,045, filed on Feb. 4, 2013.

(51) Int. Cl.

| | |
|---|---|
| ***A47C 21/06*** | (2006.01) |
| ***A47C 20/02*** | (2006.01) |
| ***A47C 27/08*** | (2006.01) |
| ***A47C 31/12*** | (2006.01) |
| ***A47C 19/02*** | (2006.01) |

(52) U.S. Cl.

CPC ..... *A47C 21/06* (2013.01); *A47C 19/027* (2013.01); *A47C 20/027* (2013.01); *A47C 27/087* (2013.01); *A47C 31/123* (2013.01)

(58) Field of Classification Search

CPC ..... A47C 21/06; A47C 19/025; A47C 19/027; A47C 20/027; A47C 23/002; A47C 23/007; A47C 31/123; A47C 27/087

See application file for complete search history.

(56) References Cited

U.S. PATENT DOCUMENTS

| | | | | |
|---|---|---|---|---|
| 2,616,100 A * | 11/1952 | Weiner | ..... | A47C 23/06 5/236.1 |
| 2,638,606 A | 5/1953 | Austin | | |
| 2,847,685 A * | 8/1958 | Freedlander | ..... | A47C 27/15 5/659 |

(Continued)

FOREIGN PATENT DOCUMENTS

| | | |
|---|---|---|
| GB | 580274 | 9/1946 |
| WO | 2014-075789 A1 | 5/2014 |

OTHER PUBLICATIONS

PCT/US16/66820 International Search Report dated Mar. 10, 2017.

*Primary Examiner* — Robert G Santos
*Assistant Examiner* — David R Hare
(74) *Attorney, Agent, or Firm* — Glenn E. Gold, P.A.; Glenn E. Gold

(57) ABSTRACT

An under mattress support extends the longevity of an existing mattress that may include concave areas resulting in sagging or soft areas, including a plurality of parallel oriented spaced-apart resilient elongated slat members interconnected by pliable strips to form a parallel slat array. The pliable strip spacing of the parallel resilient slats allows for lateral compression to enhance support. In use, the under mattress support is interposed between a mattress and underlying box spring such that the elongated slats extend along their longitudinal direction from a portion of one side of the mattress to the opposite side of the mattress where the concave portion of a sagging or soft mattress appears during the normal course of use.

18 Claims, 18 Drawing Sheets

(56) References Cited

U.S. PATENT DOCUMENTS 3,280,515 A * 10/1966 Eriksson ..... A47C 19/027 5/659
3,319,274 A * 5/1967 Upton ..... A47C 27/144 428/182
3,370,306 A * 2/1968 Lovette ..... A47C 21/06 5/659
3,751,742 A * 8/1973 Worley ..... A47C 19/027 5/659
4,644,596 A * 2/1987 Husler ..... A47C 23/06 5/191
4,654,907 A 4/1987 Haugaard
4,745,645 A * 5/1988 McWilliams ..... A47C 21/06 5/659
4,815,155 A * 3/1989 Sommers ..... A47C 19/027 5/417
4,908,887 A * 3/1990 Shaw, Jr. ..... A47C 27/001 5/419
4,955,665 A * 9/1990 Richer ..... A47C 4/52 160/84.04
5,066,001 A * 11/1991 Wilkinson ..... A63B 6/00 482/52
5,426,796 A * 6/1995 Stanton ..... A47C 17/22 5/12.1
5,459,894 A 10/1995 Buonocore
5,669,089 A * 9/1997 Dees ..... B25H 5/00 5/417
5,950,260 A * 9/1999 Dees ..... B25H 5/00 5/417
5,970,549 A * 10/1999 Rudden ..... A47C 27/10 5/655.3
6,618,883 B2 * 9/2003 Angland ..... A47C 17/04 5/12.1
6,711,762 B2 * 3/2004 Olenick ..... A47C 17/64 297/63
7,036,162 B1 * 5/2006 Gatten ..... A47C 21/04 5/420
9,241,578 B1 * 1/2016 Franken ..... A47C 21/06

* cited by examiner

UNDER MATTRESS SUPPORT

CROSS-REFERENCE TO RELATED APPLICATIONS

This U.S. non-provisional utility patent application is a continuation-in-part of U.S. non-provisional utility patent application Ser. No. 14/170,776 filed on Feb. 3, 2014, which, in turn, is a continuation-in-part of U.S. non-provisional utility patent application Ser. No. 13/758,045 (now abandoned) filed on Feb. 4, 2013, all of which are incorporated-by-reference herein in their entireties.

BACKGROUND OF THE INVENTION

Field of the Invention

The present invention generally relates to a mattress support for being interposed between an underlying box spring and overlying mattress, and more specifically to a portable under mattress support uniquely constructed to incorporate spaced-apart resilient slats interconnected by strips, for use to restore the support integrity to one or more sagging or otherwise softer well-used areas of a mattress.

Description of Related Art

Over periods of extended use, conventional mattresses tend to develop areas of sag that may develop a concave center or side area, or become too soft, greatly reducing body support and sleeping comfort. In some cases, the degree of sagging is so great that a new mattress must be purchased. In other cases, while the mattress may not be considered unusable it is uncomfortable and often leads to body aches due to lack of adequate support of the body in a preferred sleeping posture. It would be desirable to have a device that could extend the useful life and support of such a mattress, since discarding such a used mattress and purchasing a replacement mattress is often very costly. However, a crucial feature of such an under mattress support is that it adequately resolves such sagging and soft areas of the mattress without simultaneously creating a stiffer less comfortable overall mattress feel to an individual lying on the mattress.

Solutions to this issue have been attempted. However, conventional solutions have proven unsatisfactory for a variety of reasons. One attempted solution involves inserting rigid sheets, or panels, of plywood, or hard and rigid slats constructed from plastic, fiberglass, metal, wood and the like, between the box spring and the overlying mattress. Again, it has been well established that such use of rigid support structures, whether in the form of panels, slats and the like, creates an unnaturally stiff or rigid mattress feel that is uncomfortable to rest or sleep on, which is a significant drawback associated with these common approaches to the problem, and any related approaches that introduce rigid under mattress support structures. A slight variation of this approach is an individually adjustable bottom for beds, which includes the use of a pad having pockets for receiving rigid steel or fiberglass rods or stays. Again, this type of device suffers from the same disadvantages; that is, an overly rigid uncomfortable mattress support.

Another commercially available type of apparatus apparently designed to address the same problem incorporates the use of a multiple chamber air support system to provide lift to a sagging mattress. This approach has resulted in very limited support by individual air-filled chambers, which has proven to be inadequate for lifting and restoring a sagging mattress to a comfortable disposition. That is, these air chambers tend to displace, or shift the air from beneath the individual, due to the force applied by the body, to a location alongside the individual, while also creating an undesirable hardened bulge and requiring ongoing maintenance. Still other existing devices utilize flat, plastic interlocking pieces. Some devices include foldable cardboard pieces, and some devices sit atop a mattress and are made of steel rods or other hard and rigid materials, which do not provide a comfortable support for at least the foregoing reasons.

Other approaches have attempted to provide a less rigid under mattress structure intended to be inserted between a box spring and mattress immediately prior to initial use of the bed, in lieu of more rigid sheets and slats, for the purpose of providing the firm support of, for example, a plywood sheet, yet with controlled yieldability in order to give the desired degree of firmness for supporting a reclining body. However, such bed board structures (e.g., U.S. Pat. No. 2,847,685 to Freedlander) are not designed in a manner that successfully resolves existing areas of mattress sag or soft spots. Instead, they are constructed in the form of a unitary, or one-piece, uniformly thick contiguous panel, rather than a series of spaced-apart slats. As such, they do not enable displacement of the overlying mattress surface to restore the original configuration and to uplift a sagging mattress, especially where the mattress has a central or side concave area caused by extended use. This is a result of the lack of any structural features of the contiguous panel to enable expansion or contraction of the panel laterally or longitudinally. Some known structures incorporate individual spaced-apart slats; however, they incorporate a rigid ribbed construction. For example, U.S. Pat. No. 4,908,887 to Shaw, Jr. incorporates a flat rigid core sandwiched between a lightweight and insulating cushion material. As clearly stated in '887 patent, the rigid cores in the ribs are necessary to prevent an overlying mat from bending except at the flexible material hinge adjoining the ribs. Such a structure, which is specifically designed to rest upon a hard ground surface for supporting an individual, requires a rigid layer sandwiched between the outer cushioned layers due to its intended application, rendering it completely ineffective and useless as an under mattress support for the present application. Likewise, U.S. Pat. No. 2,638,606 to Austin relates to a relatively complex and cumbersome bed bottom incorporating a slatted mattress support. However, the support incorporates numerous features that render it useless for the intended purpose of the present under mattress support, including the incorporation of rigid slats running longitudinally (i.e., from the top end to the bottom end of the bed). As clearly stated in the '606 patent, the slats must be constructed of wood, steel, rattan, plastic, aluminum or some other rigid material in order to provide a relatively level base for the overlying mattress without permitting enough sag in the longitudinal direction to throw the occupant's back out of line.

Other approaches have focused on integrating complex and cumbersome multiple component systems into the original bed design aimed at, among other things, preventing material deformation and fatigue of a supported mattress. However, significantly, they are not portable under mattress supports. For example, U.S. Pat. No. 4,644,596 to Husler is directed to a cumbersome multi-component assembly comprising a permanent structural support, primarily constructed from a variety of complex individual interacting rigid structural elements, for an overlying mattress, and therefore used in lieu of a conventional box spring. Accordingly, such structures do not function as a portable under mattress support, since they are an integral subassembly of a larger overall mattress support structure.

Other structures are known that incorporate individual spaced-apart interconnected panels of resilient material for entirely unrelated applications. However, as a result of their different intended usages they lack significant features, rendering them inadequate and wholly ineffective for application as an under mattress support. For example, U.S. Pat. No. 5,066,001 to Wilkinson teaches a portable, foldable, adjustable aerobic bench/step/mat including individual panels secured by flexible hinges. However, due to the requirement that the structure be adapted to be converted between a flat exercise mat, a bench and an aerobic step, the design of the hinges, the spacing that the hinges create between adjacent panels, and the relative gap created by the hinges vis-à-vis the size of the adjoined panels must be such that they enable adjacent panels to be precisely stacked upon one another to increase the height for converting the apparatus from a flat mat to a stacked step or bench. As a result, the required structure hinders the ability to roll up the panels into a rolled form for packaging, storage and the like. Furthermore, the structure of the hinges is specifically designed to prevent displacement of adjacent hinges with respect to one another and, therefore, prevent freedom of movement of adjoined panels with respect to one another. Therefore, the '001 patent and similar structures specifically prevent displacement of adjacent panels (i.e., preventing any degree of freedom to move toward or away from one another) which is a crucial feature of the under mattress support of the present invention.

Significantly, the problem being addressed herein is not one of providing an orthopedic or other medical-related solution for people with extreme back issues by over-supporting or hardening the mattress surface. To the contrary, the invention described herein is specifically designed, configured and adapted to enhance existing softer and sagging regions of a well-used mattress so that the mattress continues to provide comfort and support for typical individuals while sleeping, and at the same time extends the useful life of the current mattress by restoring the mattress to its original shape and comfort.

With the use of the under mattress support described herein, the use and wear of any mattress can be extended to continue to provide comfort and support for one or more individuals while sleeping, and reducing the expense associated with purchasing a replacement mattress due to sagging or concave pockets and deformities due to extended use. The under mattress support described herein is positioned under a mattress and on top of its accompanying box spring or similar mattress support. That is, the under mattress is positioned interposed between the box spring and mattress. Furthermore, the under mattress support of the present invention is constructed to provide the flexibility to either stack the slat (or encased slat) portions or to roll up the apparatus to facilitate packaging options for sale and storage.

SUMMARY OF THE INVENTION

Various implementations of an under mattress support are provided for extending the use of a sagging mattress, the under mattress support functions to raise the height of a sagging or soft area or region of a mattress to restore it to its original configuration.

In one general implementation, an under mattress support is provided for positioning between a box spring support and a sagging area of an overlying mattress, the box spring support and overlying mattress having corresponding sides extending longitudinally between upper and lower ends of the respective box spring and mattress ends. The under mattress support includes: (a) a series of parallel spaced-apart laterally extending elongated resilient unitary slats, each slat having a predetermined width and height and a predetermined slat length adequate to extend laterally from a portion of one of the sides of the mattress to a portion of the opposite side of the mattress; (b) a unitary bottom pliable fabric cover disposed beneath the slats such that the bottom pliable fabric cover extends completely beneath all of the slats; and (c) a top pliable fabric cover disposed above the slats such that the top pliable fabric cover extends completely above all of said slats, the top pliable fabric cover selectively fixedly attached to said bottom pliable fabric cover in a manner resulting in the permanent encasement of each of said resilient slats within a corresponding unique slat enclosure such that each individual encased slat has a contiguous exterior surface completely surrounded by, and directly adjacent to, a corresponding contiguous interior surface of the corresponding unique slat enclosure. In this manner, each unitary resilient slat is completely permanently encased within a corresponding unique enclosure rendering the slat inaccessible. Preferably, the selective attachment further includes first and second laterally-extending linear cover attachment portions each permanently affixing the top and bottom fabric covers to one another along the length of the respective attachment portion, the cover attachment portions disposed in a predetermined desired spaced-apart relationship to one another within an area between adjacently positioned first and second enclosed slats having opposing corresponding first and second slat lateral sides, a first one of the attachment portions running adjacent to the first slat lateral side, and a second one of the attachment portions running adjacent to the second slat lateral side to form a pliable fabric strip having a strip width of at least approximately one inch and having a fabric strip length equal to a corresponding length of each slat enclosure as measured from the opposite edges of adjoined top and bottom pliable fabric covers enclosing opposite ends of each resilient slat, such that opposite ends of each pliable fabric strip extend laterally for a length directly corresponding to opposite edges of the adjoined top and bottom pliable fabric covers enclosing the slat ends. In this manner, an under mattress support periphery is created that is defined by linear edges, wherein the formed pliable fabric strips enable and facilitate lateral compression of the under mattress support when the under mattress support is in use supporting the mattress, each of the formed pliable fabric strips having adequate resiliency to enable selective rolling of the under mattress support longitudinally along the respective lengths of the pliable fabric strips to enable the under mattress support to be easily rolled up into a compact configuration, thereby facilitating compact packaging of the under mattress support prior to initial use, and subsequent compact storage of the under mattress support when not in use.

In a further aspect, each pliable fabric strip separating each pair of adjacent enclosed resilient slats has a strip width adequate to maintain a minimum spacing between the adjacent enclosed slats within a range of approximately 2 inches to 5 inches.

In a further implementation, the top pliable fabric cover may be selectively permanently attached to the bottom pliable fabric cover by either stitching or chemical adhesive.

In a further aspect, the top pliable fabric cover may be selectively permanently attached to the bottom pliable fabric cover along each lateral side of each resilient slat, forming an enclosure of the top pliable fabric cover and the bottom pliable fabric cover completely around each resilient slat.

In a further aspect, each of the plurality of pliable fabric strips may extend laterally from the attachment of the top pliable fabric cover to the bottom pliable fabric cover along each lateral side of each resilient slat such that each pair of adjacent resilient slats are parallel to one another and spaced apart from one another a predetermined distance to allow lateral compression of each resilient slat when the mattress support is properly placed interposed between the mattress and the box spring during use.

In a further aspect, each slat may be comprised of a rectangular polyhedron slat having a height within a range of 1 inch to 4 inches and a width within a range of 2 inches to 5 inches.

In a further aspect, each polyhedron slat may be constructed of resilient material having a foam density within a range of 1.5 to 1.8 pounds per cubic foot.

DETAILED DESCRIPTION OF THE PREFERRED IMPLEMENTATIONS

Figure 1:
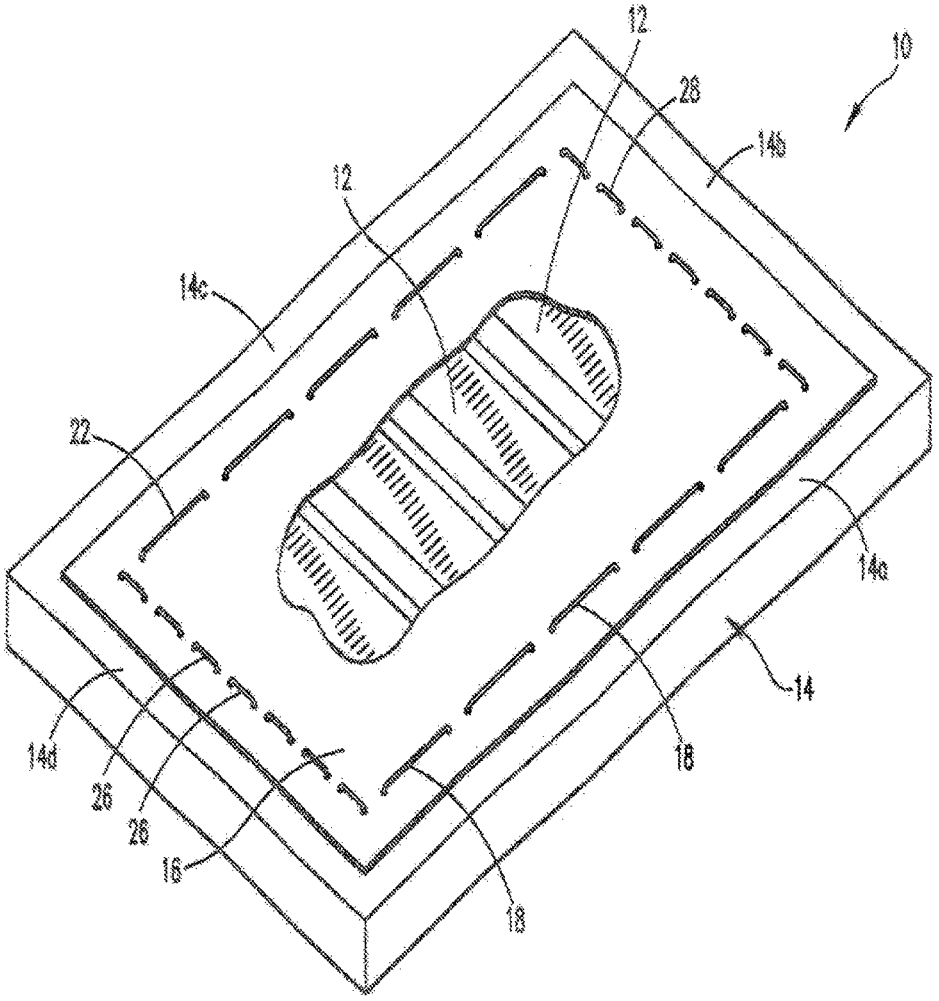
FIG. 1 shows a perspective view of a first exemplary implementation of the under mattress support of the present invention with a top cover (16) shown partially cut away to expose interior resilient slats.

Referring now to the drawings and in particular to a first exemplary implementation of FIG. 1, the under mattress support 10 is shown. The support 10 includes an array comprising a plurality of elongated unitary resilient slats 12, such as, for example, but not limited to, elongated heavy duty polyurethane foam slats, expanded polyethylene slats; expanded polypropylene slats; expanded polyurethane slats; expanded polystyrene, rubber slats, polyethelene-styrofoam composite slats or any other resilient materials having similar characteristics, which are now known or discovered in the future and preferably capable of being easily formed into any desired geometric shape. Preferably, the slats 12 are arranged parallel to each other and spaced-apart preferably within a range of about 2 inches to 5 inches, as shown. However, the slat separation between adjacent slats can fall outside of this preferred range if required by a specific mattress or box spring construction. The lateral cross-section of each slat 12 may take on any of a myriad of geometric polyhedron shapes, including, for example, rectangular and hexagonal shapes, as well as non-polyhedron shapes such as, but not limited to, cylindrical and elliptical shapes. Although a particular slat geometry may be depicted in a particular drawing figure, it will be apparent to those skilled in the art that the present invention lends itself to the use of any geometric shape that does not hamper the intended functionality of the under mattress support. Accordingly, although specific slat geometries are depicted in specific drawing figures, the particular geometry is merely exemplary and should not be construed as limiting. Although the lengths of the slats are preferably equal, the actual measured length of each slat will depend upon factors such as the particular size bed with which the under mattress support will be utilized. The mattress support may be used on single or twin beds, double beds, full beds, queen-sized beds, king-sized beds, and California king sized beds. The chosen length of each slat 12 is determined primarily by the size of the mattress. Depending upon the size of the mattress, either one or multiple under mattress supports may be used.

Referring now primarily to the implementation depicted in FIGS. 1 through 4, each of the slats 12 has a series of cords sewn into and out of areas of the slats 12 in order to hold the slats together in a parallel array at each end of the slats. The cords also extend along the topside of each of the slats 12 near each end and the bottom side of the slats. The cords also extend along the top side of each of the slats near each end and the bottom side of the slats. As shown in FIG. 1, there are four separate cords 18, 22, 26 and 28 sewn into the ends and sides of the slat array. End cords 26, 28 are sewn into different parallel resilient slats of opposite ends of the device 10. Each of the cords can be made of any desired material such as fabric or artificial plastic as long as it is sufficiently strong to bind the resilient slat 12 together in a supportive array.

Referring particularly to FIG. 1, a bottom cover 14 is provided made of a fabric cloth such as cotton and which has overlapping top edges 14*a*, 14*b*, 14*c* and 14*d*. A separate top cover 16 is shown. The top cover 16 is preferably made of a quilter's batting material, or another non-slip material, in order to contact the bottom surface of the mattress (not shown) to prevent mattress movement between the upper mattress and the lower box spring and the under mattress support that constitutes the invention. The cords 18, 22, 26 and 28 shown in FIG. 1 are also used to sew and attach the bottom cotton cover 14 shown and the top cover 16 shown together. The slats 12, the bottom cotton cover 14, the top cover 16, and the cords 18, 22, 26 and 28, constitute the under mattress supporting device.

Figure 2:
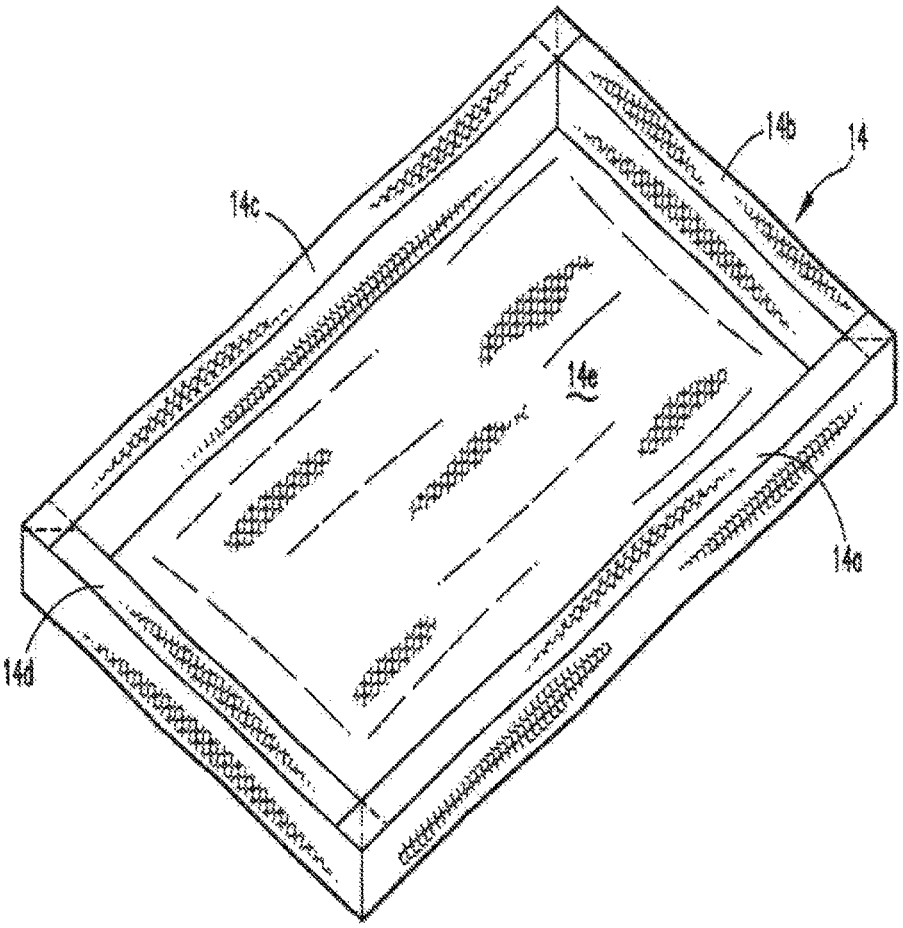
FIG. 2 shows a perspective view of the bottom cover of the under mattress support of FIG. 1.

Referring now particularly to FIG. 2, the bottom cover 14 includes a bottom surface 14*e* and a plurality of overlapping top edges 14*a*, 14*b*, 14*c* and 14*d*. These top edge surface areas of cover 14 engage top cover 16 shown in FIG. 3 such that the cords can also be used to sew and fasten the bottom cover 14 shown in FIG. 2 to the top cover 16 shown in FIG. 3 to the resilient slats 12 to maintain the slats in parallel and spaced-apart relation to one another. The bottom cover 14 is made from cotton or other suitable fabric.

Figure 3:
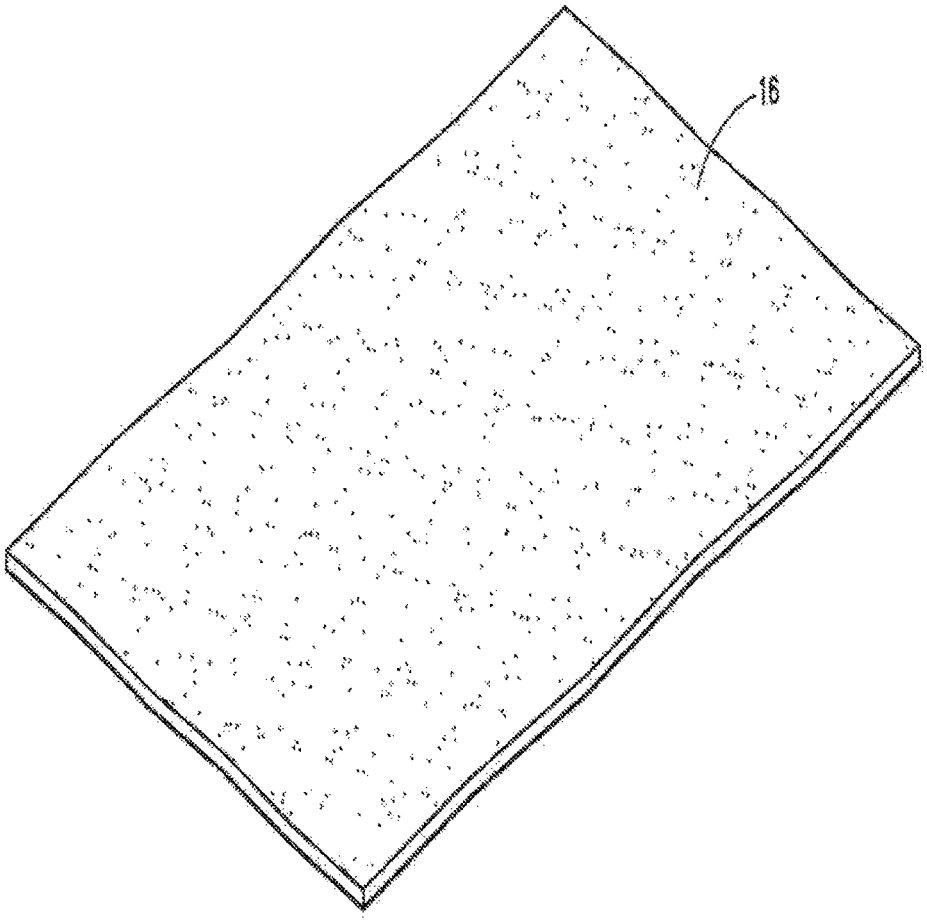
FIG. 3 shows a perspective view of the top cover of the under mattress support of FIG. 1.

FIG. 3 shows the top cover 16 which may, for example, be constructed of quilter's batting so that the mattress (not shown) will not slide relative to the under mattress cover 10. The length and width of the top cover 16 is larger than the opening provided by the bottom cover 14 top edges as shown in FIG. 1. The top cover 16 is secured in place and fastened to the bottom cover top edges by the cords shown in FIG. 1 and to the slats 12 to hold the slats fixed in place.

Figure 4:
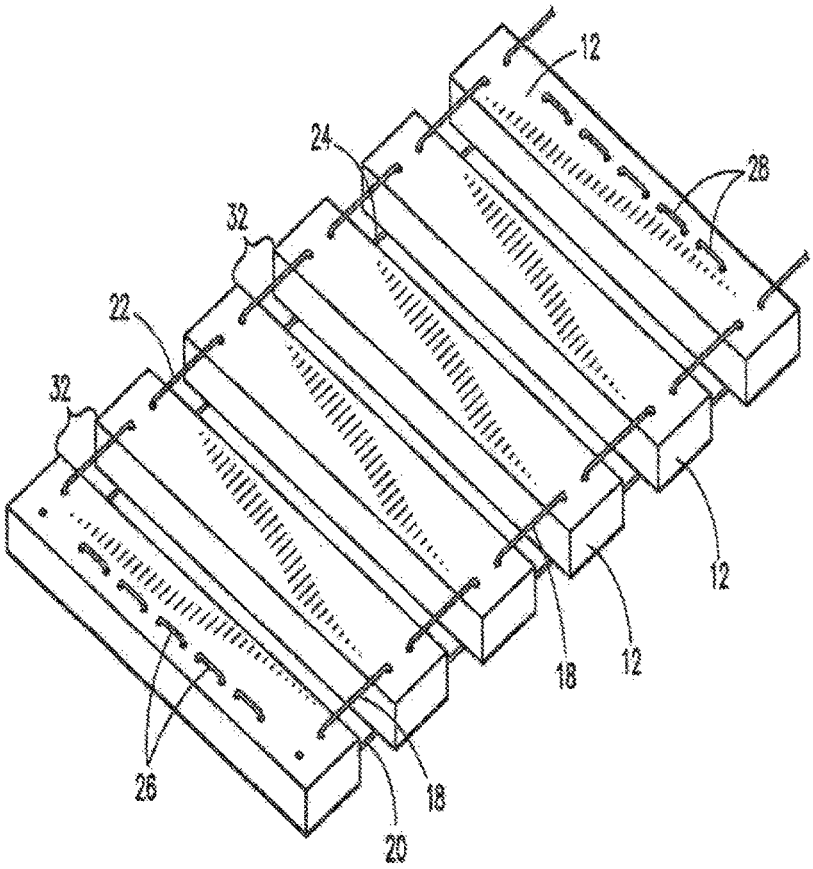
FIG. 4 shows a perspective view of the interior resilient slat assembly utilized in the under mattress support of FIG. 1.

FIG. 4 shows the array of resilient slats 12 connected together by cords without the top cover 16 and the bottom cover 14 for illustrative purposes only. The slats 12 are spaced apart as shown by element 32 for preventing pressure spots along the mattress and for reducing heating. The cords 18 and 20 at one end of the slats and the cords 22 and 24 at the opposite ends of the slats 12 in conjunction with the cords 26 and 28 at the top and bottom of the slat array provide fastening of the entire array unit to the top and bottom covers, 16 and 18, respectively, as shown in FIG. 1.

Due to the flexibility of the fabric bottom cover 14 shown in FIG. 2 and the flexibility of the top cover 16 shown in FIG. 3, the primary support force provided by the under mattress support will be achieved from the parallel resilient slats 12. By providing slat-to-slat spacing within the preferred range of 2 inches to 5 inches, shown in between each slat 12, the mattress support 10 also can reduce heat buildup between the mattress and box spring when in use. The slat 12 element spacing also allows for prevention of pressure points that may be caused by a unitary support structure since the slats are all spaced equally apart.

The orientation of the slats 12 is such that the length of the slats 12 extends across a portion of the mattress from side to side, or laterally. Thus, the under mattress support size will be determined by the length of the slats 12 which will also be determined by the size of the bed and mattress to be supported.

Tying or sewing each slat 12 to its adjacent slat 12 with strong cords 18, 22 at opposite ends and cords 26, 28 at the opposite sides of the under mattress support 10 provide a strong but non-complex method of securing the array of slats together in a parallel array and simultaneously providing a non-complex solution to attaching the bottom cover 14 to the top cover 16. It is possible in an alternate implementation that the bottom cover 14 shown in FIG. 2 and the top cover 16 shown in FIG. 3 could be physically attached to one another by stitching them together and to the individual slats 12 through known sewing techniques.

Figure 5:
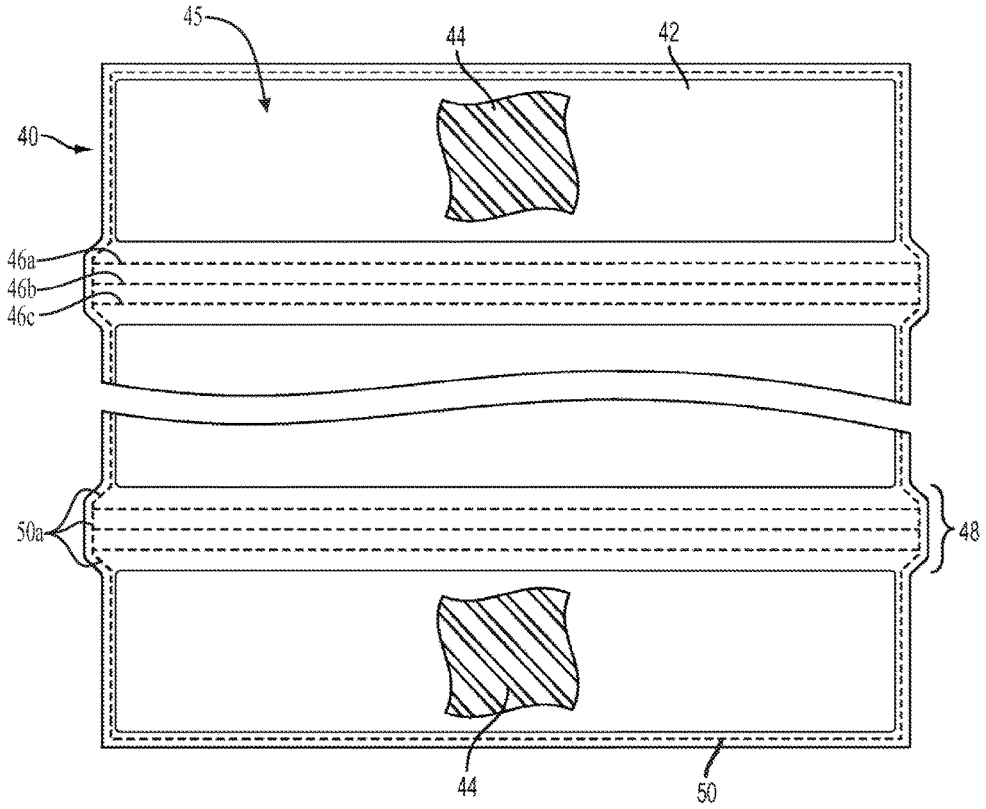
FIG. 5 is a top plan view of an alternate implementation of the under mattress support, with areas of a top cover 42 of individual slat enclosures 45 shown partially cut away to expose interior resilient slats 44.
Figure 6:
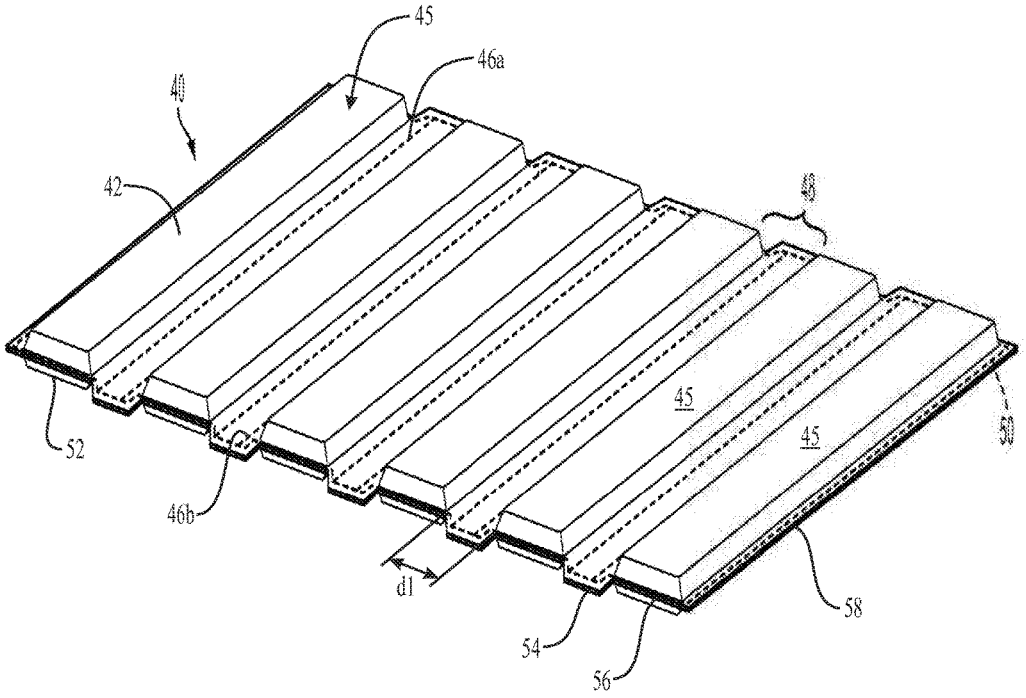
FIG. 6 is a perspective view of the alternate implementation of FIG. 5.

Referring now primarily to FIGS. 5 and 6, in an alternate implementation of the under mattress support 40 the resilient slats 44 are completely encased in fabric by sewing together a top fabric cover 42 and a bottom fabric cover 52. By stitching the top fabric cover 42 and the bottom fabric cover 52 together completely around each resilient slat 44, including the ends by threaded stitch 50 and creating a separate fabric strip 48 between adjacent resilient slats 44, an important separation is provided between each slat laterally, which is essential for the best performance of the under mattress support 40. The fabric strip 48 which may be formed, for example, by sewing stitching preferably provides at least approximately 2-inches to 5-inches between the lateral sides of parallel disposed adjacent slats 44. Each fabric strip 48 may include multiple lateral threaded stitch lines 46*a*, 46*b*, 46*c*, and perimeter threaded stitching 50*a*. Along with additional perimeter stitching 50, a continuous perimeter stitch line is provided completely around the under mattress support 40 joining the top fabric cover 42 to the bottom fabric cover 52. The fabric strip 48 is flexible to allow folding of the under mattress support for packaging or storage purposes in either a stacked configuration or a rolled configuration. In an implementation, the fabric used for the top and bottom covers, 42 and 52, respectively, may be a non-woven material. The cover fabric may be made of a natural or synthetic pliable woven or non-woven material. The cover material can also be made of a pliable cloth or fabric non-slip material. Significantly, the flexible fabric strip 48 also facilitates temporary displacement of adjoined slat enclosures 45 with respect to one another.

The quantity of resilient slats 44 can be varied depending upon the area of the mattress being supported. The length of the slats 44 and the device can be any desired length, again depending upon the area of the mattress to be supported.

Figure 5A:
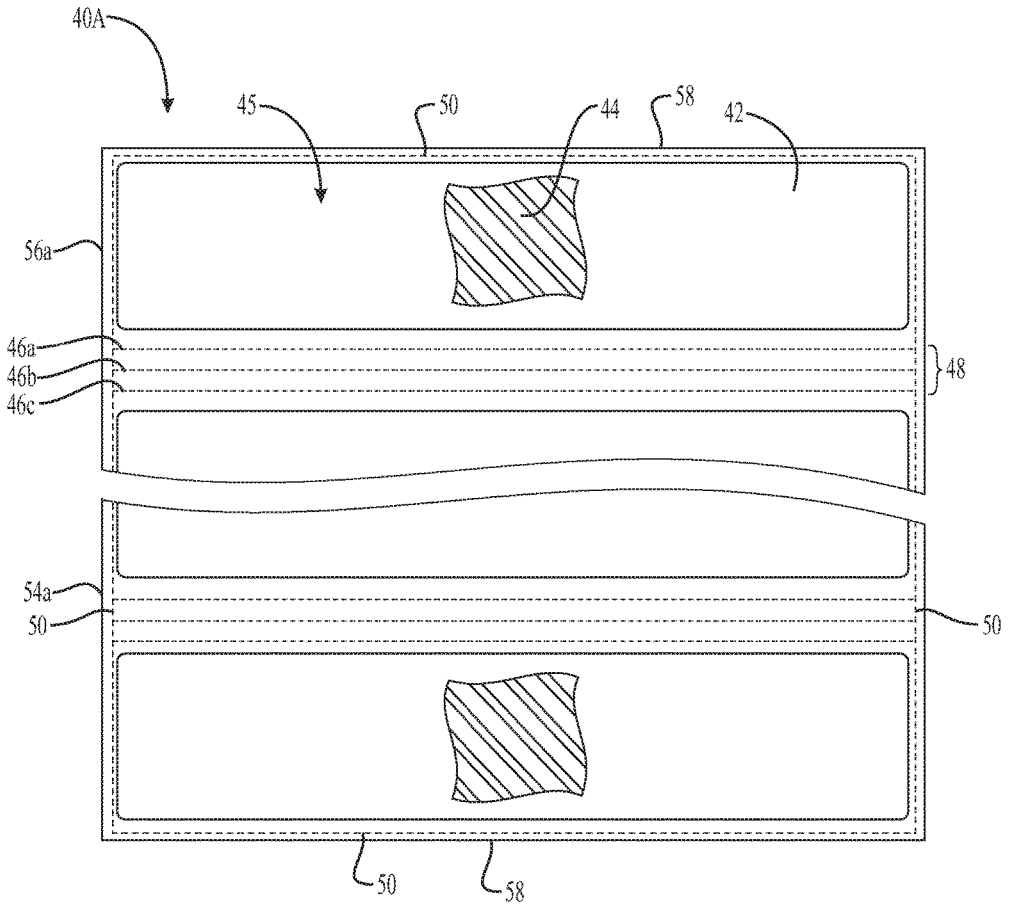
FIG. 5A is a top plan view of an alternate implementation of the under mattress support originally introduced in FIG. 5, wherein each side of the periphery is linear to form a rectangular shape when the support is in a completely laid out state.
Figure 6A:
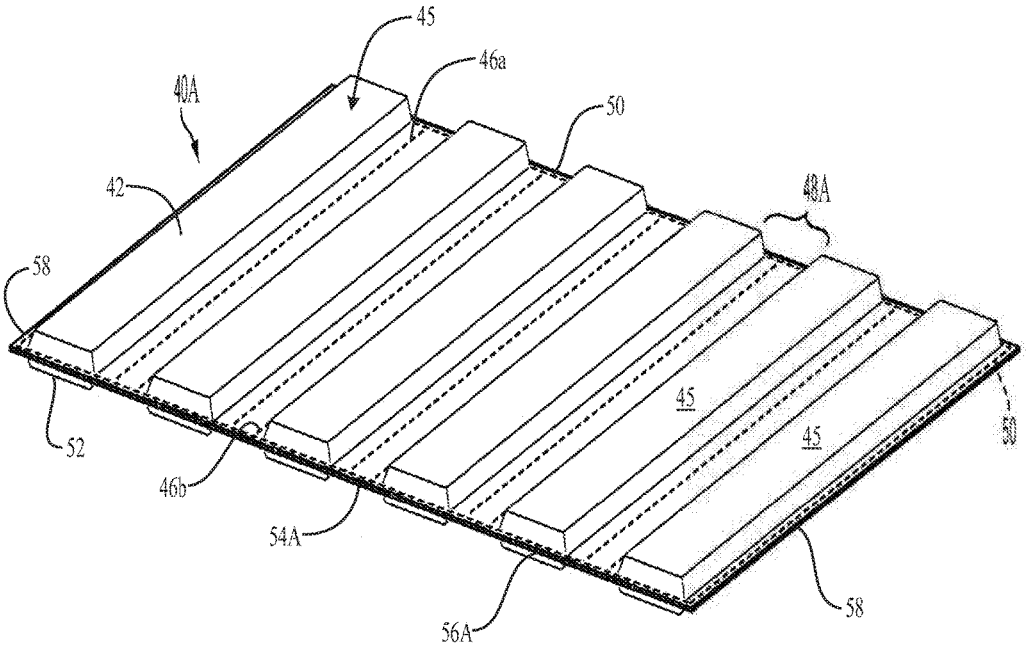
FIG. 6A is a perspective view of the alternate implementation of FIG. 6.

Referring now to FIGS. 5A and 6A, as will be apparent to those skilled in the art, the under mattress support originally shown in FIGS. 5 and 6 could be slightly altered such that peripheral stitch line 50 is provided as a continuous peripheral stitch line formed of four linear stitch lines, one running the length of each side. In this case, the peripheral edges of the under mattress support 40*a* are all linear, with the edges 56A of the periphery located at the ends of the slat enclosures 45 in alignment with the corresponding edges 54A of the periphery located at the ends of the separating strips 48A, and the upper and lower ends 58 remaining linear.

Figure 7:
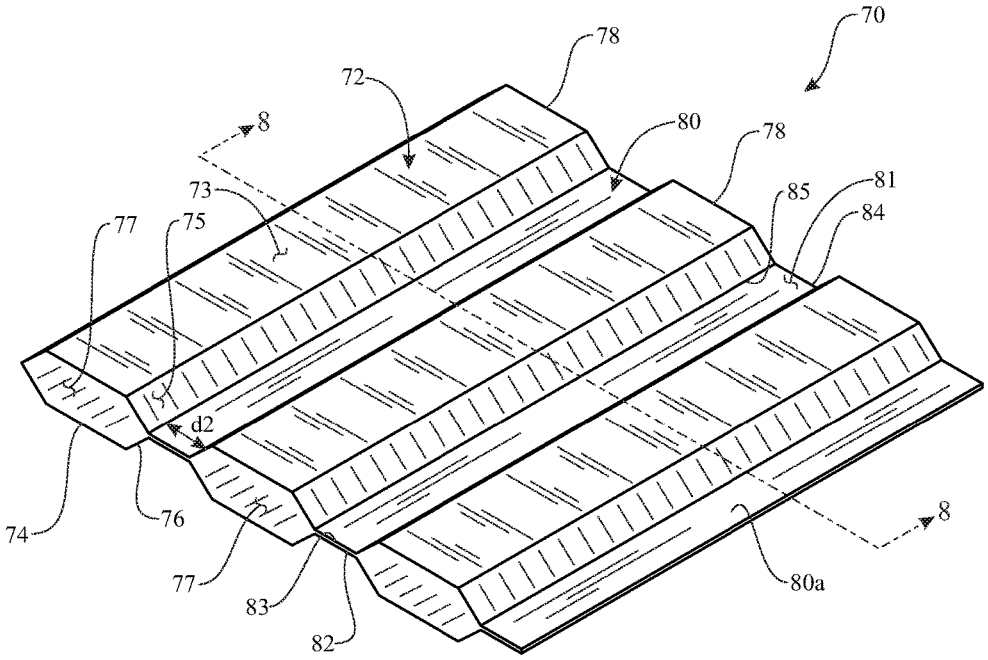
FIG. 7 is a perspective view of an alternate implementation of the under mattress support constructed as a unitary resilient body, depicting exemplary hexagonal-shaped slat portions.
Figure 7A:
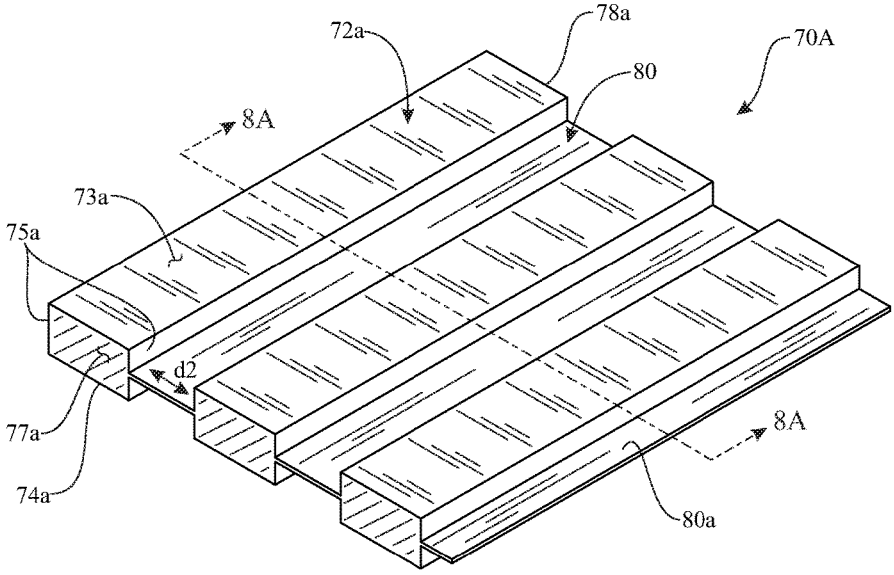
FIG. 7A is a perspective view of the alternate implementation introduced in FIG. 7, but incorporating rectangular slat portions, in lieu of the exemplary hexagonal slat portions of FIG. 7.
Figure 8:
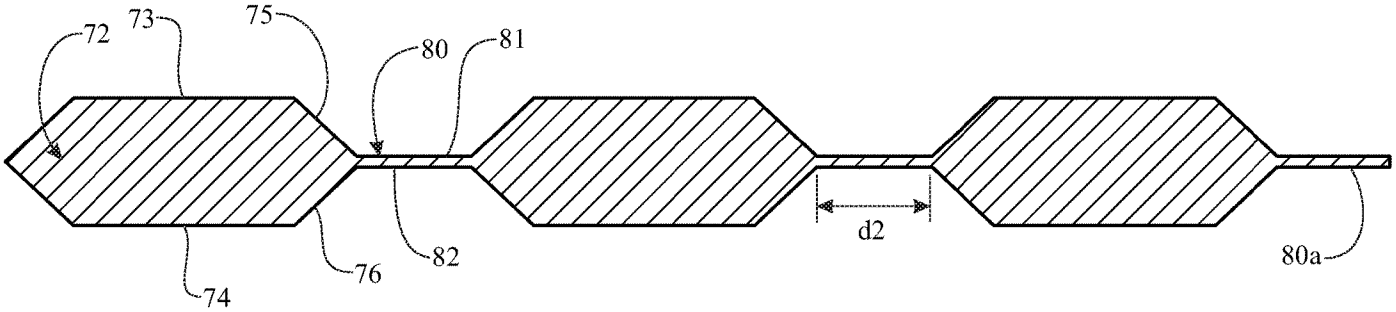
FIG. 8 is a cross-sectional view taken along section lines 8-8 of FIG. 7.
Figure 8A:
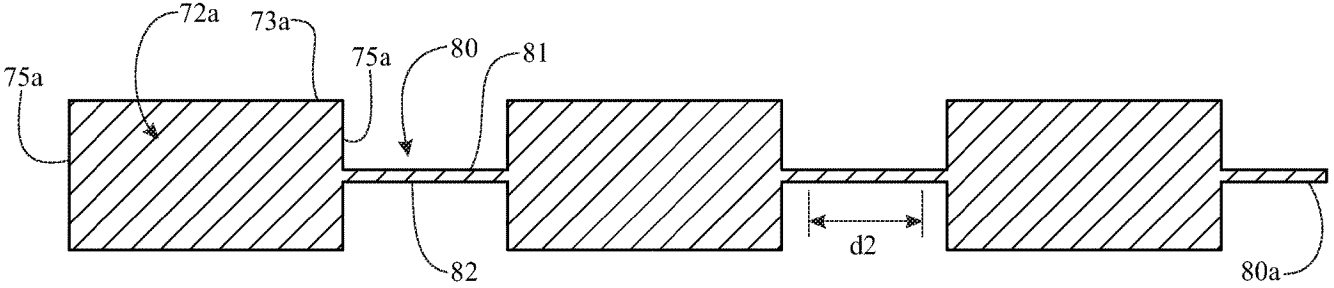
FIG. 8A is a cross-sectional view taken along section lines 8A-8A of FIG. 7A.

Referring now briefly to FIGS. 7 and 7A, in a further implementation an under mattress support is constructed as a unitary structure. Initially, it should be noted that the Figures only depict three slats for convenience. In use, however, it is contemplated that each under mattress support 70, 70*a* may include more or less multiple parallel spaced-apart slat portions. As previously stated, the geometry of the resilient slat members or portions of the invention can be varied without departing from the intended scope of the invention. Accordingly, FIG. 7 depicts a unitary body 70 incorporating hexagonal shaped slat portions, while FIG. 7A depicts a unitary body 70*a* incorporating more-preferred rectangular slat portions 72*a*. Preferably, the unitary body 70, 70*a* is constructed from any of the aforementioned resilient materials previously described with regard to FIGS. 1 through 6. Referring now particularly to FIGS. 7 and 8, each slat portion 72 includes an upper side 73, an opposite lower side 74, opposite ends 77, 78, and sides 75, 76. Adjacent slats 72 are adjoined by integral resilient strip portion 80, along intersecting linear portion 85, preferably positioned midway between upper and lower sides, 73 and 74, respectively. Each integral resilient strip portion 80, defining a separation distance, $d_2$, between adjacent slats 72, is generally defined by an upper surface 81, an opposite lower surface 82, and opposite edges 83, 84. Optionally, an end strip portion 80*a* may be provided for facilitating handling and maneuvering of the under mattress support 70 during use. Referring briefly to FIGS. 7A and 8A, an under mattress support 70A is shown having the same structure as described with regard to the under mattress support 70 in FIG. 7, with the exception that each resilient slat portion 72*a* is provided having a rectangular cross-sectional geometry. In this case, each slat portion 72*a* includes an upper side 73*a*, an opposite lower side 74*a*, opposite ends 77*a*, 78*a*, and opposite vertical sides 75*a*. Again, integral resilient strip portions 80 define a separation distance, $d_2$, between adjacent slats 72*a*.

Figure 9:
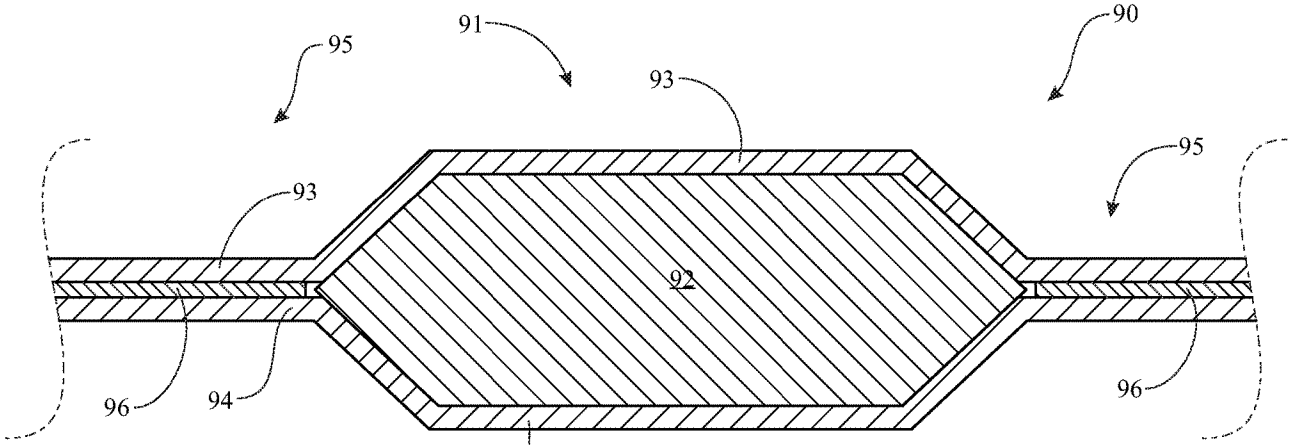
FIG. 9 is a cross-sectional view illustrating an alternate implementation of a single slat enclosure (as originally introduced in FIGS. 5 and 5A) illustrating the use of a chemical adhesive, in lieu of stitching, to adjoin the upper and lower fabric coverings along the adjoining fabric strip portions (95)
Figure 9A:
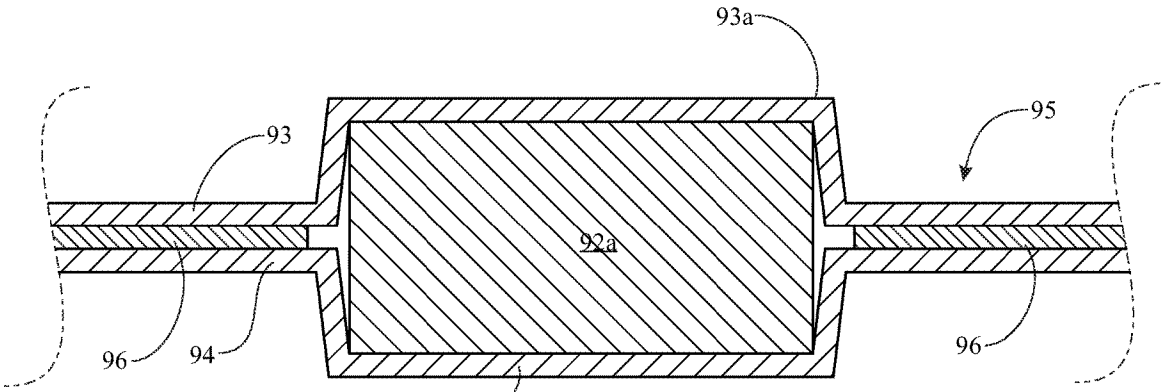
FIG. 9A is a cross-sectional view illustrating an alternate implementation of a single rectangular shaped slat enclosure (as originally introduced in FIGS. 5 and 5A) illustrating the use of a chemical adhesive, in lieu of stitching, to adjoin the upper and lower fabric coverings along the adjoining fabric strip portions (95)

Referring now briefly to FIGS. 9 and 9A, cross-sectional views of a single resilient slat, one depicted having a hexagonal geometry (FIG. 9) and one depicted having a rectangular geometry (FIG. 9A), are provided to illustrate an alternate implementation of the embodiments originally introduced in FIGS. 5, 5*a*, 6 and 6*a*, wherein an upper fabric covering layer 93 and a lower fabric covering layer 94 surround each resilient slat and are affixed to one another via a layer of chemical adhesive 96 (in lieu of stitching or other attachment methods) interposed between the upper and lower covering layers, 93 and 94, respectively, along the fabric strip portions 95 of the under mattress support. As will be apparent to those skilled in the art, any other known means for selectively attaching the cover layers to the underlying resilient slat including, but not limited to, heat sealing techniques and mechanical fastening structures, are contemplated.

Figure 10:
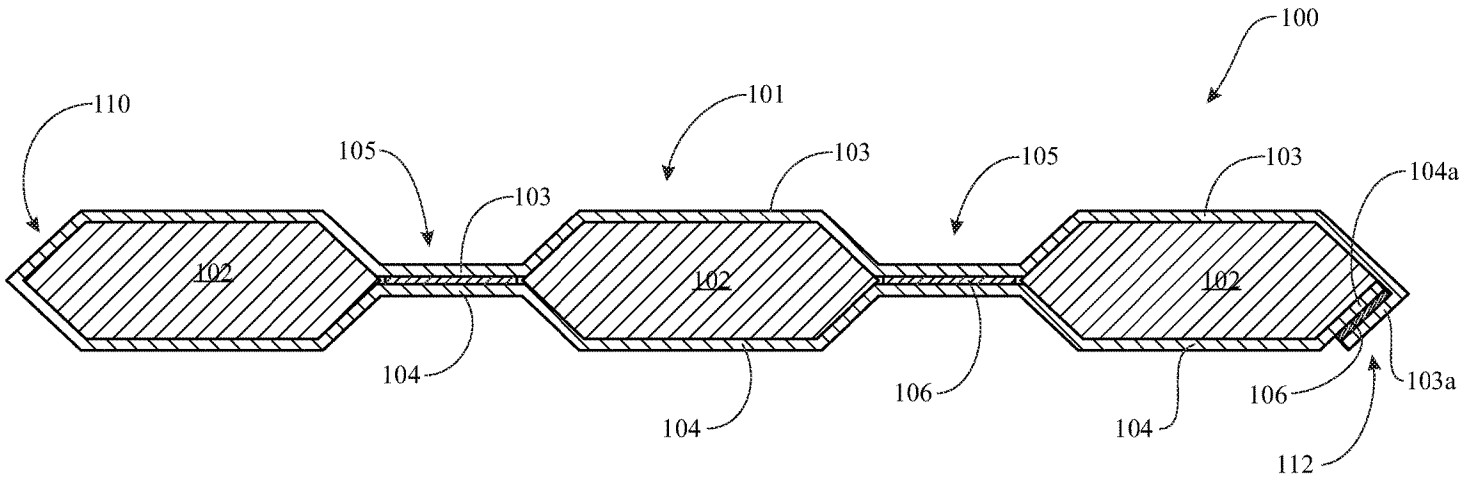
FIG. 10 is a cross-sectional view illustrating an alternate implementation of the under mattress support (as originally introduced in FIGS. 5 and 5A), utilizing a single contiguous panel of fabric covering having adhesively adjoined upper and lower fabric strip portions, and incorporating an adhesively adjoined overlapping fabric cover end portion.
Figure 10A:
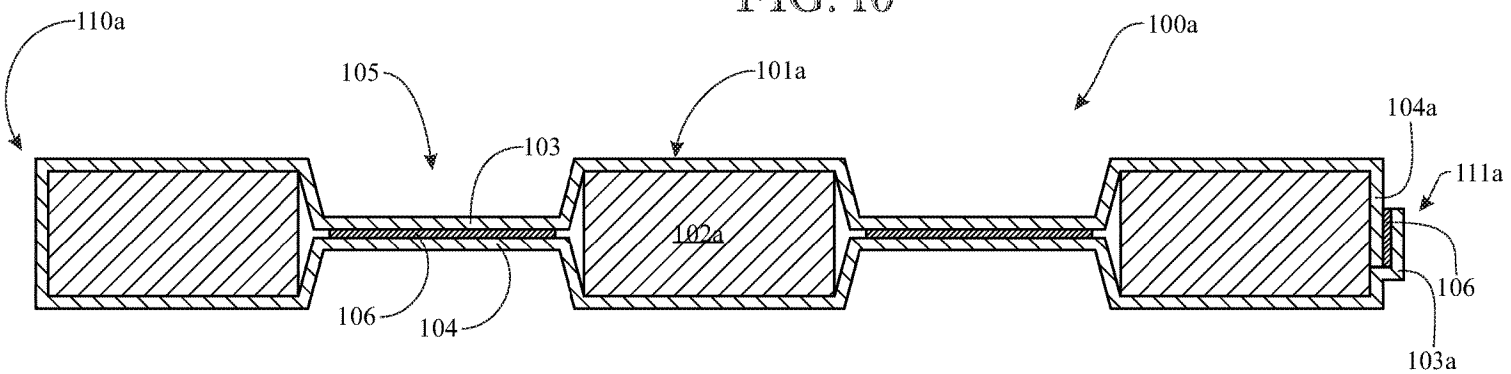
FIG. 10A is a cross-sectional view illustrating an alternate implementation of the under mattress support (as originally introduced in FIGS. 5 and 5A), utilizing a single contiguous panel of fabric covering having adhesively adjoined upper and lower fabric strip portions, and incorporating an adhesively adjoined overlapping fabric cover end portion.

Referring now to FIGS. 10 and 10*a*, cross-sectional view are provided depicting an alternate implementation of the under mattress support of the present invention, wherein a single panel of fabric covering is utilized, in lieu of the dual fabric panel structure previously described with respect to FIGS. 1 through 6A. Again, the only difference between FIGS. 10 and 10*a* is the incorporation of a hexagonal resilient slat 102 (FIG. 10) and a rectangular slat 102*a* (FIG. 10A). In this alternative implementation, a single contiguous panel of fabric covering, having portions denoted by different reference numbers 103, 104, 103*a* and 104*a*, is extended from a first end 111, 111*a* completely around an opposite second end 110, 110*a* and then portions 103*a*, 104*a* proximate the free edges of the covering partially overlapped and affixed to one another using a chemical adhesive. Furthermore, the resilient strip portions 105 are formed by affixing an upper portion 103 of the covering to a lower portion 104 of the covering between adjacent slats 102, 102*a* preferably via chemical adhesive 106.

Figure 11:
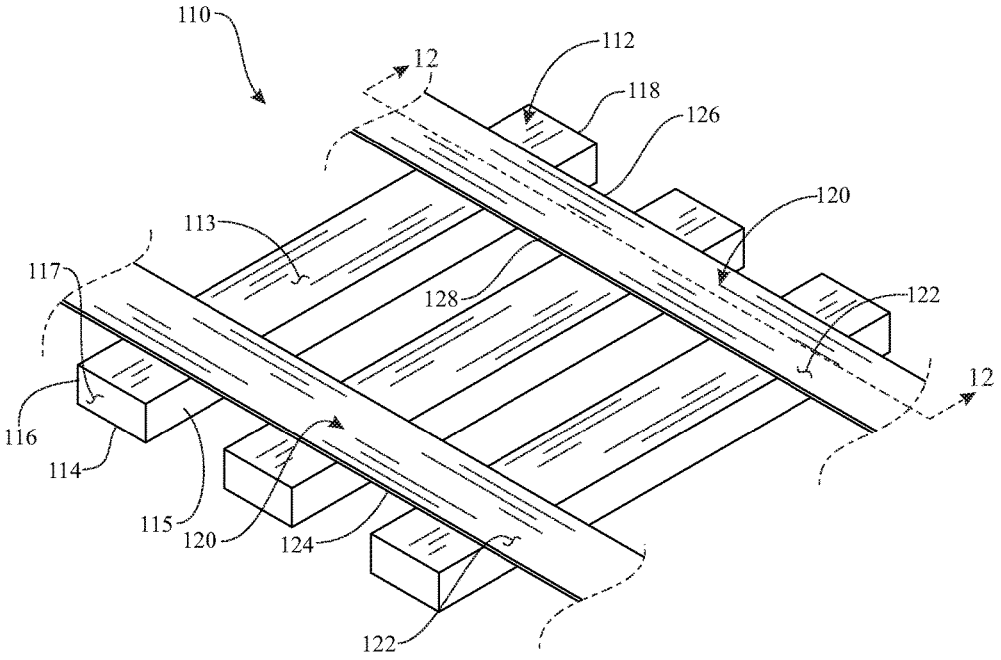
FIG. 11 is a perspective view of an alternate implementation of an under mattress support incorporating a series of spaced-apart resilient slats affixed to one another by individual ribbons of flexible material adhered to an exterior surface of each slat, maintaining the slats in a parallel spaced-apart relationship.
Figure 12:
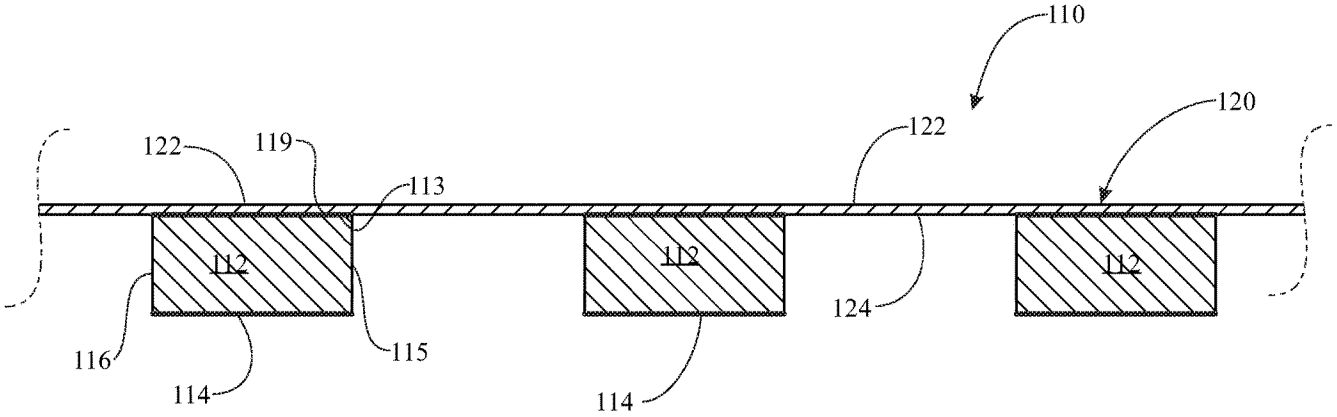
FIG. 12 is a cross-sectional view taken along section line 12-12 of FIG. 11.

Referring now to FIGS. 11 and 12, in a further implementation of the present invention an under mattress support 110 is constructed by affixing a plurality of spaced-apart resilient slats 112 to one another via a pair of spaced-apart lengths of ribbon 120. Each resilient slat 112 is defined by a top 113, a bottom 114, sides 115, 116, and opposite ends 117, 118. Each ribbon 120 includes an upper surface 122 and a lower surface 124. Each ribbon is selectively adhered to the slats 112 via a layer of adhesive 119 interposed between the top 113 of slat 112 and the lower surface 124 of ribbon 120. Although the lengths of ribbon 120 are depicted attached to the upper surfaces 113 of the slats 112, this is merely for convenience. In this implementation, the lengths of ribbon 120 could just as readily be affixed to the bottom surfaces 114 of the slats 112 to achieve the same result. The ribbon 120 is constructed from a non-rigid flexible substrate, which maintains the preferred spaced-apart parallel relationship of the slats 112 while also enabling movement or displacement between adjacent slats, as heretofore discussed.

Figure 11A:
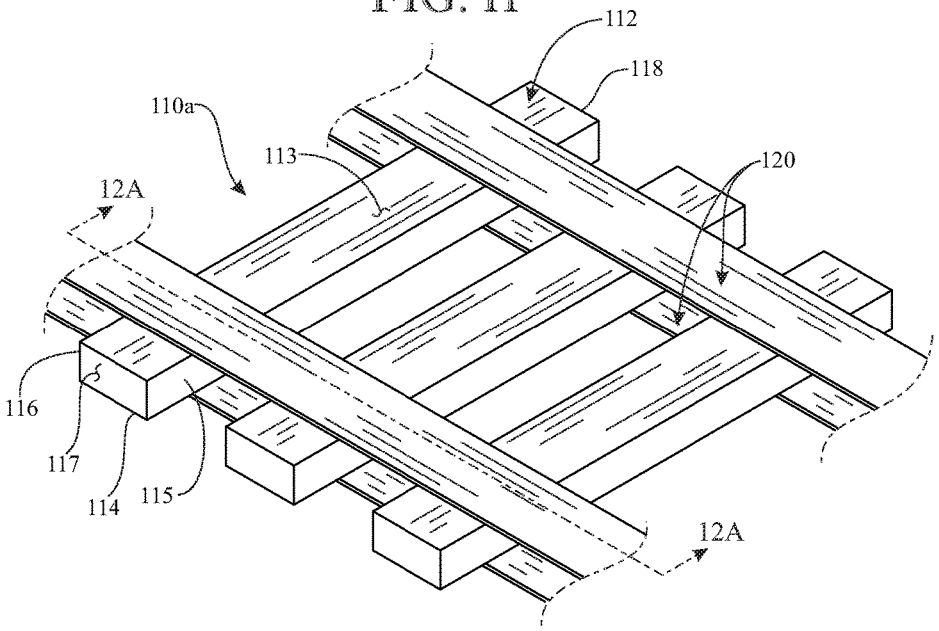
FIG. 11A is a perspective view of an alternate implementation of an under mattress support similar to that introduced in FIG. 11, but incorporating rectangular slats and illustrating the optional use of one or more individual ribbons of flexible material affixed to both top and bottom surfaces of the series of spaced-apart resilient slats.
Figure 12A:
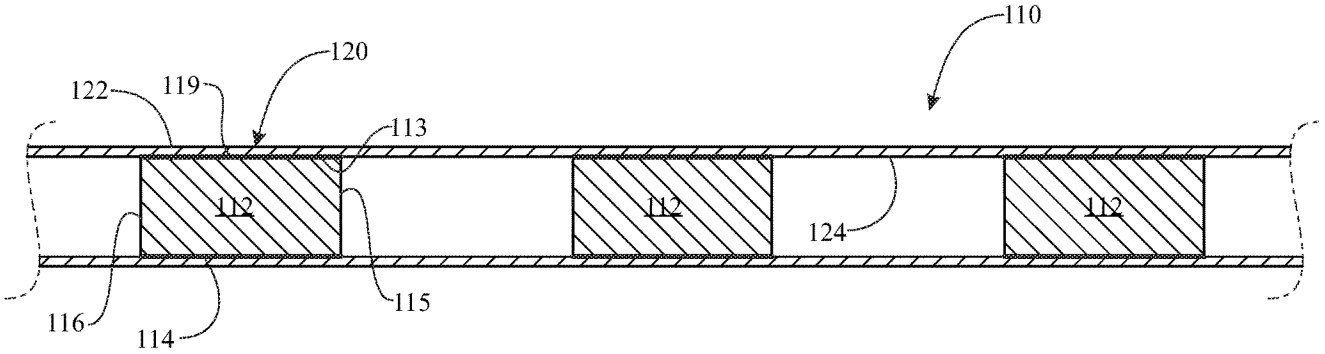
FIG. 12A is a cross-sectional view taken along section line 12A-12A of FIG. 11A.

Referring now to FIGS. 11A and 12A, in a further implementation of the present invention an under mattress support 110*a* is constructed by affixing a plurality of spaced-apart resilient slats 112 to one another via a pair of spaced-apart lengths of ribbon 120 along both the upper surfaces 113 and lower surface 114 of each slat. Furthermore, in lieu of using individual segments of ribbon 120 along the top and bottom surfaces 113, 114, it is contemplated that single lengths of ribbon 120 may be completely wrapped around opposite ends of the series of resilient slats 112.

Figure 13:
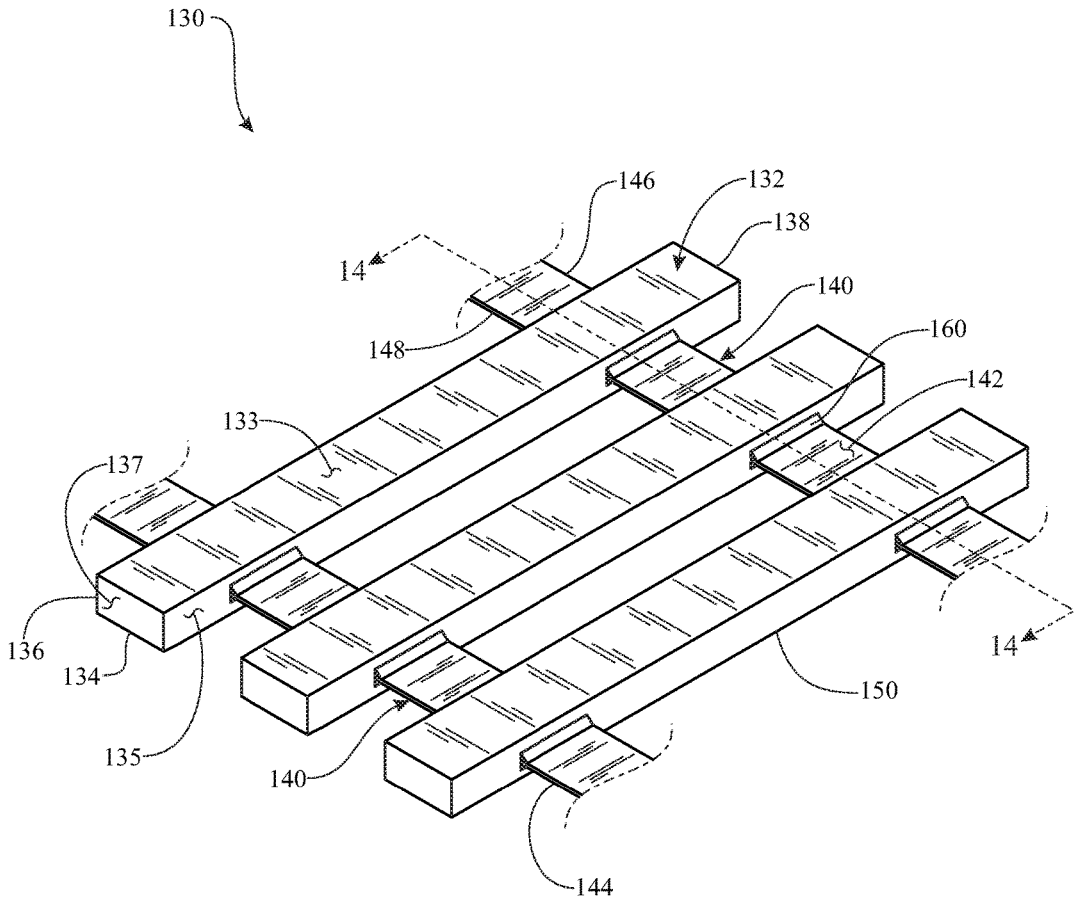
FIG. 13 is a perspective view of an alternate implementation of the under mattress support incorporating a series of spaced-apart resilient slats affixed to one another by a plurality of individual strips segments having opposite ends extending partially through the lateral sides of each pair of adjacent slats and permanently affixed thereto.
Figure 14:
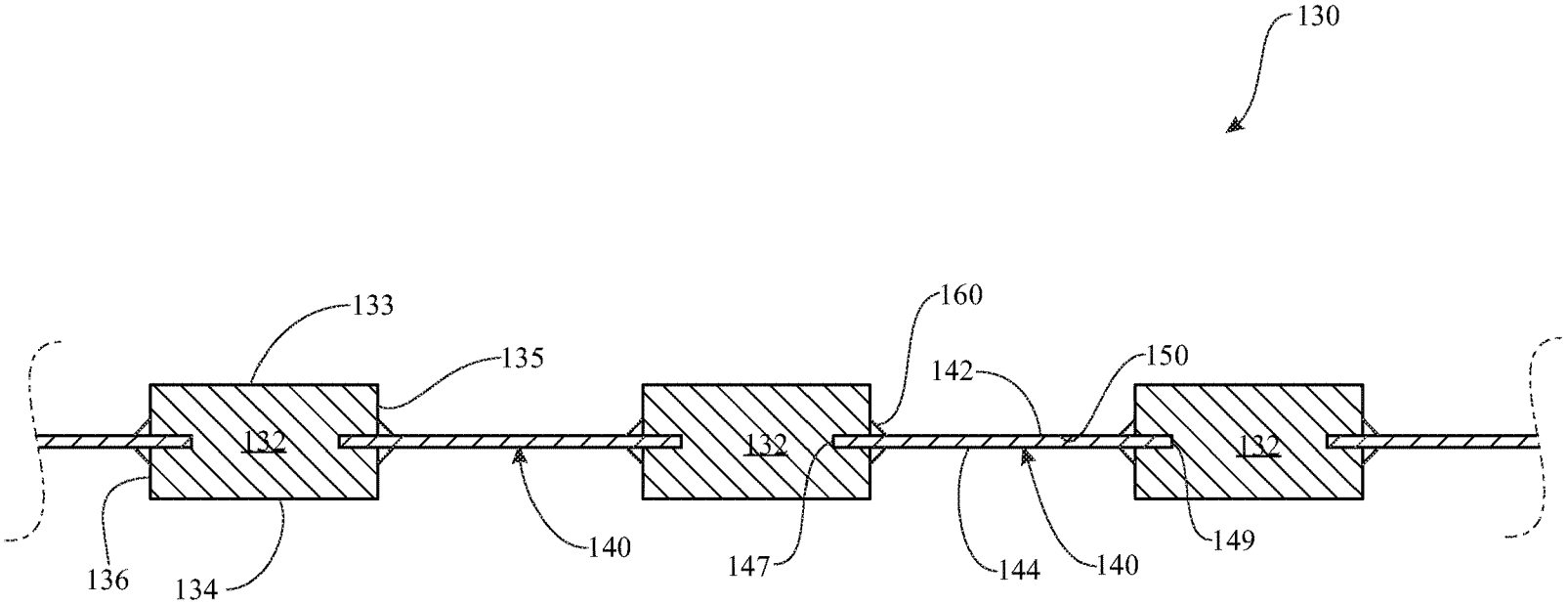
FIG. 14 is a cross-sectional view taken along section line 14-14 of FIG. 13.

Referring now to FIGS. 13 and 14, in a further implementation of the present invention an under mattress support 130 is constructed by attaching a plurality of parallel spaced-apart resilient slats 132 via a plurality of segments 140 of ribbon. Each resilient slat 132 is defined by a top 133, a bottom 134, opposite sides 135, 136 and opposite ends 137, 138. In this implementation, individual segments of ribbon 140, each defined by a top 142, a bottom 144, and side edges 146, 148, have opposite ends 147, 149 each extending partially into and through opposing sides 135 of adjacent resilient slats 132, functioning to hold the slats together. The individual ribbon segments may be integrally molded into the slats. Furthermore, the opposite ends 147, 149 of each ribbon segment may be inserted into slits formed in the opposing sides 135 of adjacent resilient slats and fixed via mechanical stops 160.

Figure 15:
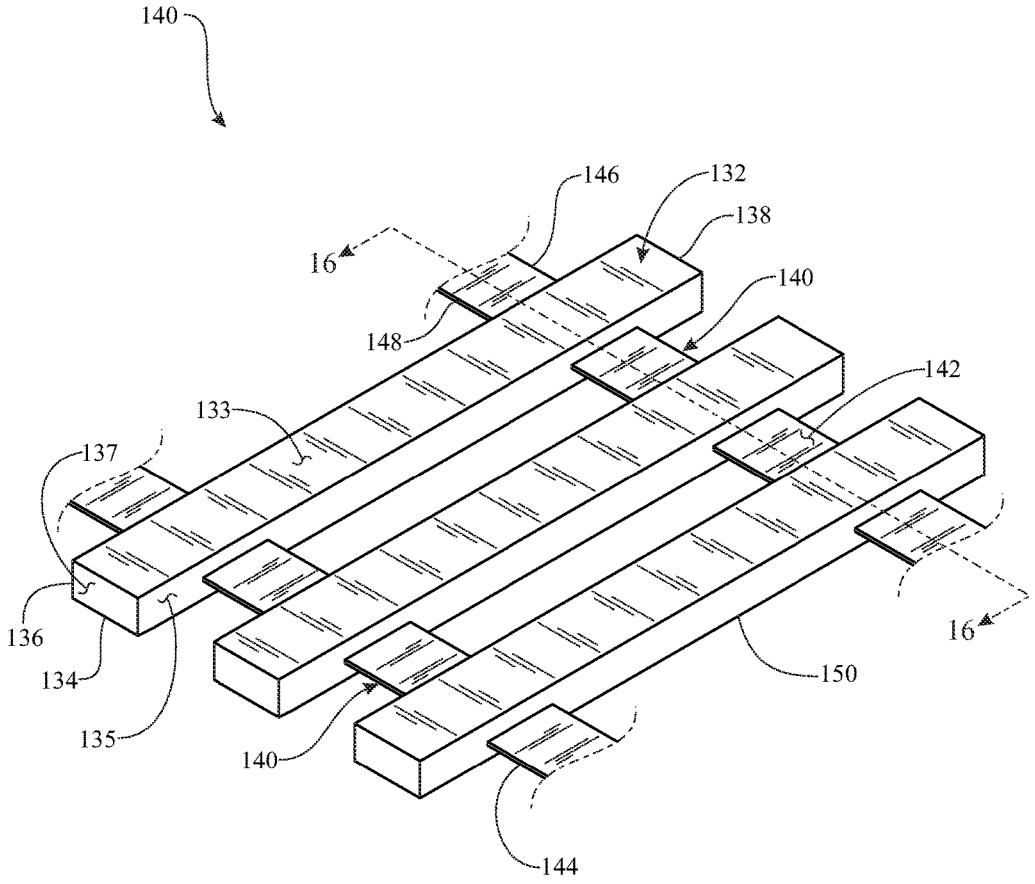
FIG. 15 is a perspective view of an alternate implementation of the under mattress support incorporating a series of spaced-apart resilient slats affixed to one another by a pair of contiguous strip lengths each extending completely through the lateral sides of all of the resilient slats.
Figure 16:
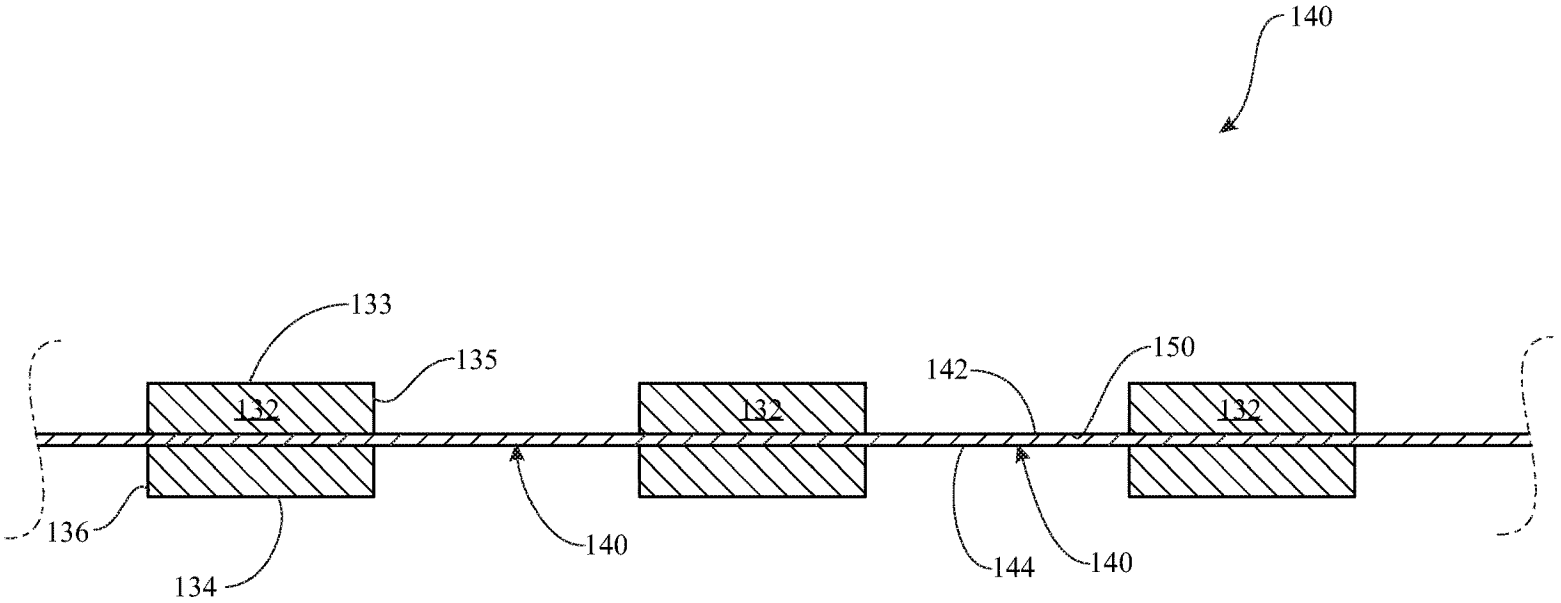
FIG. 16 is a cross-sectional view taken along section lines 16-16 of FIG. 15.

Referring now to FIGS. 15 and 16, in a further implementation of the present invention, an under mattress support 140 is constructed by attaching a plurality of parallel spaced-apart resilient slats 132 via contiguous lengths of ribbon 140. Each resilient slat 132 is defined by a top 133, a bottom 134, opposite sides 135, 136 and opposite ends 137, 138. In this implementation, each contiguous length of ribbon 140, defined by a top 142, a bottom 144, and side edges 146, 148, extends completely through the sides 135 of each of the resilient slats 132, functioning to hold the slats together. The individual ribbon segments are preferably integrally molded into the slats 132. However, as previously described with respect to FIGS. 13 and 14, mechanical stops 160 (not shown in FIGS. 15 and 16) may be used to further secure each length of ribbon 140 to the corresponding attached slats 132 to prevent any sliding of the portions of ribbon encased within the respective slats 132.

Referring now specifically to the structure of the resilient slats depicted and described herein, preferably have compression strength, measured longitudinally, that will be sufficient to eliminate sagging areas or concave areas in a well-used or soft mattress without making the supported mattress uncomfortable. In an exemplary implementation, heavy duty polyurethane foam slats may have a foam density within a range of 1.5 to 1.8 Pounds per Cubic Foot (PCF), and the heavy duty polyurethane foam slats may have a firmness of approximately 35 ILD (Indentation Load Deflection—where the ILD number is measured as the pounds of pressure to compress the foam 25 percent). Other foam densities and firmness values can be utilized. The foam slats have some give and resiliency so that they do not act like rigid boards or rigid plastic that would otherwise make the supported mattress uncomfortable. In one exemplary implementation, each of the resilient foam slats would have a width within a range of 2 inches to 5 inches, and a height of 1 inch to 4 inches, with the length determined by the mattress size. The polyurethane foam is selected to have a desirable compression force with some resiliency and durability for extended daily use. When using commercial polyurethane foam, the foam should preferably be heavy duty polyurethane foam.

In a preferred embodiment of the various implementations, the heavy duty polyurethane is described generally as a rectangular polyhedron. However, as will be apparent to those skilled in the art, it is feasible that the slats could take on any of a myriad of alternate geometries including, for example, hexagonal polyhedrons (as shown in some of the drawings figures) as well as non-polyhedrons (such as elliptical geometries), as long as the selected geometry provides the support characteristics desired.

Resilient slats made of resilient material can be varied in dimensions including width and thickness. The spacing between the parallel slats on their lateral sides can also be varied as long as there is sufficient space to adequately allow the slats to compress laterally during support of the mattress.

The under mattress support disclosed herein is utilized by inserting the mattress support between the box spring and the sagging area of the mattress to be supported. The lengths of the slats may be selected to extend from a portion of one side of the mattress to a portion of the other side of the mattress.

The utilization of the under mattress support described herein can greatly prolong the life of a desirable but sagging or soft mattress, and can restore the mattress to its original shape and comfort, which the prior art does not accomplish.

The length and width of the under mattress support described herein can be varied dependent upon the size of the mattress and box spring with which the under mattress support is being used. The instant invention has been shown and described herein in what is considered to be the most practical and preferred implementations or embodiments. It is recognized, however, that departures may be made therefrom within the scope of the invention and that obvious modifications will occur to a person skilled in the art.

What is claimed is:

1. An under mattress support for positioning between a box spring support and a sagging area of an overlying mattress, the box spring support and overlying mattress having corresponding sides extending longitudinally between upper and lower laterally-extending ends of the respective box spring and mattress, the under mattress support comprising:

a series of parallel spaced-apart laterally-extending elongated resilient unitary slats, each slat having a predetermined width and height, and a predetermined slat length adequate to extend laterally from a portion of one of the sides of the mattress to be supported to a portion of the opposite side of the mattress to be supported;

a unitary bottom pliable fabric cover disposed beneath the slats such that the bottom pliable fabric cover extends completely beneath the entire series of slats; and a top pliable fabric cover disposed above the slats such that the top pliable fabric cover extends completely above all of said slats, the top pliable fabric cover selectively fixedly attached to said bottom pliable fabric cover in a manner forming a permanent encasement of each of said resilient slats within a corresponding unique slat enclosure such that each individual encased slat has a contiguous exterior surface completely surrounded by, and directly adjacent to, a corresponding contiguous interior surface of the corresponding unique slat enclosure, thereby completely permanently encasing each unitary resilient slat within a corresponding unique enclosure rendering the slat inaccessible; and said selectively fixedly attached top and bottom pliable fabric covers further comprising first and second laterally-extending linear cover attachment portions each permanently affixing the top and bottom fabric covers to one another along the length of the respective attachment portion, the cover attachment portions disposed in a predetermined desired spaced-apart relationship to one another within an area between adjacently positioned first and second enclosed slats having opposing corresponding first and second slat lateral sides, a first one of the attachment portions running adjacent to the first slat lateral side, and a second one of the attachment portions running adjacent to the second slat lateral side, forming a pliable fabric strip having a strip width of at least approximately one inch and having a fabric strip length equal to a corresponding length of each slat enclosure as measured from the opposite edges of adjoined top and bottom pliable fabric covers enclosing opposite ends of each resilient slat, such that opposite ends of each pliable fabric strip extend laterally for a length directly corresponding to opposite edges of the adjoined top and bottom pliable fabric covers enclosing the slat ends and thereby creating an under mattress support periphery defined by linear edges, wherein each of said formed pliable fabric strips enable and facilitate lateral compression of said under mattress support when the under mattress support is in use supporting said mattress, each said formed pliable fabric strip having adequate resiliency to enable selective rolling of said under mattress support longitudinally along the respective lengths of each of said pliable fabric strips to enable the under mattress support to be easily rolled up into a compact configuration, thereby facilitating compact packaging of said under mattress support prior to initial use, and subsequent compact storage of said under mattress support when not in use.

2. An under mattress support as recited in claim 1, wherein:

said pliable fabric strip separating each pair of adjacent enclosed resilient slats has a strip width adequate to maintain a minimum spacing between said adjacent enclosed slats within a range of approximately 2 inches to 5 inches.

3. An under mattress support as recited in claim 1, wherein:

said top pliable fabric cover is selectively permanently attached to said bottom pliable fabric cover by at least one of stitching and an adhesive.

4. An under mattress support as recited in claim 1, wherein:

said top pliable fabric cover is selectively permanently attached to said bottom pliable fabric cover along each lateral side of each resilient slat, forming an enclosure of the top pliable fabric cover and the bottom pliable fabric cover completely around each resilient slat.

5. An under mattress support as recited in claim 4, wherein:

each of said plurality of pliable fabric strips extends laterally from the attachment of said top pliable fabric cover to said bottom pliable fabric cover along each lateral side of each resilient slat such that each pair of adjacent resilient slats are parallel to one another and spaced apart from one another a predetermined distance to allow lateral compression of each resilient slat when the mattress support is properly placed interposed between said mattress and said box spring during use.

6. An under mattress support as recited in claim 5, wherein each slat further comprises:

a rectangular polyhedron slat having a height within a range of 1 inch to 4 inches and a width within a range of 2 inches to 5 inches.

7. An under mattress support as recited in claim 6, wherein:

each polyhedron slat is constructed of resilient material having a foam density within a range of 1.5 to 1.8 pounds per cubic foot.

8. An under mattress support as recited in claim 5, wherein each of said plurality of pliable fabric strips provides slat lateral spacing having a distance within a range of 2 inches to 5 inches.

9. An under-mattress support for interposing between a mattress-supporting base and a mattress disposed upon an upper surface of the mattress-supporting base, an upper surface area of the mattress having a contiguous periphery generally defined by a pair of laterally-extending upper and lower mattress ends adjoined by a corresponding pair of longitudinally-extending left and right lateral mattress sides, the upper surface of the mattress having an undesirable sagging area having a maximum sagging area lateral distance and a maximum sagging area longitudinal distance, the under-mattress support comprising:

a plurality of parallel laterally-extending elongated unitary resilient slats in a uniformly spaced-apart relationship to one another, each slat bounded by opposite upper and lower surfaces, opposite front and rear side surfaces, and opposite left and right ends, each slat having a predetermined width, a predetermined height and a predetermined length; and a plurality of parallel laterally-extending pliable strips, each strip interposed between a laterally-extending front side surface of a first resilient slat and an opposing laterally-extending rear side surface of an adjacent second resilient slat, in a manner enabling and facilitating translation of said parallel first and second adjacent resilient slats with respect to one another, wherein said pliable fabric strips function to maintain adjacent ones of said series of parallel spaced-apart laterally-extending elongated resilient unitary slats in said spaced-apart relationship both when the under mattress support is in an in-use configuration and when the under mattress support is in a rolled-up configuration.

10. An under-mattress support as recited in claim 9, wherein said predetermined slat lateral length is adequate to extend laterally between said left and right lateral mattress sides for a distance greater than said maximum mattress sagging area lateral distance.

11. An under-mattress support as recited in claim 9, further comprising a fabric covering completely encasing said plurality of parallel laterally-extending elongated unitary resilient slats, said fabric covering having an upper covering portion and a lower covering portion selectively attached to one another to form a contiguous rectilinear fabric covering periphery, a plurality of covering pockets each permanently encasing a single one of said resilient slats, and said plurality of parallel laterally-extending pliable strips each having a strip width interposed between the opposing laterally-extending front and rear side surfaces of each pair of adjacent slats.

12. An under-mattress support as recited in claim 11, wherein said selective attachment further comprises a series of fabric stitches forming a contiguous rectilinear stitch line defining a generally rectilinear under-mattress fabric covering stitch line perimeter.

13. An under-mattress support as recited in claim 12, wherein said selective attachment further comprises a series of laterally-extending stitch lines forming said pliable fabric strip widths.

14. An under-mattress support as recited in claim 13, wherein said selective attachment further comprises a series of at least two lateral stitch lines each extending between opposite sides of said stitch line perimeter.

15. An under-mattress support as recited in claim 14, wherein said selective attachment further comprises a series of at least three lateral stitch lines each extending between opposite sides of said stitch line perimeter.

16. An under mattress support as recited in claim 12, wherein said selective attachment further comprises a layer of chemical adhesive selectively interposed between upper and lower portions of said fabric covering to form said pliable strip widths.

17. An under-mattress support as recited in claim 11, wherein said selective attachment further comprises a series of adhesive layers selectively interposed between said upper and lower fabric covering portions to form said contiguous rectilinear fabric covering periphery, and said pliable fabric strip widths.

18. An under-mattress support as recited in claim 10, wherein said plurality of parallel laterally-extending elongated resilient slats and said plurality of parallel laterally extending pliable strips form a solid resilient unitary structure.

* * * * *